United States Patent [19]

Glesmann

[11] Patent Number: 4,722,637

[45] Date of Patent: Feb. 2, 1988

[54] AUTOMATIC TILT ADJUSTING BRACKET FOR A CONCRETE FINISHING FLOAT

[75] Inventor: Herbert C. Glesmann, Omaha, Nebr.

[73] Assignee: Marshalltown Trowell Company, Marshalltown, Iowa

[21] Appl. No.: 40,207

[22] Filed: Apr. 16, 1987

Related U.S. Application Data

[63] Continuation-in-part of Ser. No. 853,466, Apr. 18, 1986, abandoned.

[51] Int. Cl.[4] ..... E01C 19/44

[52] U.S. Cl. ..... 404/118; 404/97

[58] Field of Search ..... 404/97, 118; 15/235.4, 15/235.5, 235.8; 425/458

[56] References Cited

U.S. PATENT DOCUMENTS

| | | | |
|---|---|---|---|
| 1,590,342 | 6/1926 | Abram | 404/97 X |
| 2,448,548 | 9/1948 | Purdy . | |
| 2,586,472 | 2/1952 | McKown | 404/97 X |
| 2,833,188 | 5/1958 | Wilkens | 404/97 X |
| 2,934,937 | 5/1960 | Bennett | 15/235.8 |
| 2,999,261 | 9/1961 | Lapham | 404/118 X |
| 3,090,066 | 5/1963 | Ferrell et al. | 15/235.8 |
| 3,146,481 | 9/1964 | Chiuchiarelli | 15/235.8 |
| 3,729,765 | 5/1973 | Peterson | 15/235.8 |
| 3,798,701 | 7/1974 | Irwin et al. | 15/235.8 |

FOREIGN PATENT DOCUMENTS

| | | | |
|---|---|---|---|
| 726300 | 5/1932 | France | 15/235.4 |
| 971200 | 1/1963 | United Kingdom . | |

OTHER PUBLICATIONS

Advertisement for Hustler Bull Float Bracket and Handle.

*Primary Examiner*—James A. Leppink
*Assistant Examiner*—Matthew Smith
*Attorney, Agent, or Firm*—Allegretti, Newitt, Witcoff & McAndrews, Ltd.

[57] ABSTRACT

An automatic tilt adjusting bracket for connection between a pole handle and a concrete float blade. The bracket includes a base member, a cover member and mechanical linkage interconnecting the base and cover members. As the pole handle is pushed and pulled, a force is applied to the cover member pivoting the base member relative thereto for automatically lifting the leading edge of the float blade.

15 Claims, 8 Drawing Figures

AUTOMATIC TILT ADJUSTING BRACKET FOR A CONCRETE FINISHING FLOAT

This application is a continuation-in-part of application Ser. No. 853,466, filed Apr. 18, 1986, now abandoned.

BACKGROUND OF THE INVENTION

The invention relates to an automatic attack angle adjusting bracket for a concrete finishing float, of the type generally known as a bull float, and more particularly relates to a device which causes the leading edge of a concrete float to automatically lift in response to the pushing or pulling force routinely applied by the worker to the handle of the float to maneuver the float over the surface being smoothed.

A concrete bull float includes a generally rectangular finishing blade or float and an elongated pole handle attached to the center of the float. A worker uses the pole handle to push the float forward and pull the float backward across the work surface in order to smooth the concrete. The handle of the float may be formed from several pole sections that are interconnected by couplings of the threaded, telescoping/spring-pin locked or similar type.

As the worker manipulates the currently typical long handled float, he tilts the leading edge of the finishing face slightly upwards away from the concrete surface as he pulls or pushes the float. The tilting of the float pushes the concrete in the direction that the float is being moved and prevents the leading edge of the trowel from digging into the concrete being smoothed. As the concrete begins to dry, the wetness of the concrete changes. With drier concrete, the workers must tilt the leading edge of the float higher to provide more action to smooth the concrete. With wet concrete, the worker puts less tilt in the leading edge of the float to prevent the blade from plowing the concrete. Thus, the worker must be able to manipulate the face of the float at various angular positions while maneuvering the trowel over the concrete.

Where the float face is fixed in a rigid relationship to the handle, the adjustment in the angle of the face is made by the worker raising and lowering the handle to tilt the face. Where the concrete surface covers a wide area, the handle of the trowel may be up to twenty-four feet long. With such a long handle, the worker must repetitively straighten up, raise hands and arms above the head, then bend downward and drop arms in order to manipulate the trowel. Clearly, adjustment of the trowel angle relative to the concrete is difficult and exhausting to the worker.

In order to avoid putting the worker through this series of calisthenics, the angle of the float blade relative to the handle is made adjustable by the worker. Heretofore, this angle adjustment has been accomplished in a number of different ways.

For example, L. L. Bennett in U.S. Pat. No. 2,934,937 issued on May 3, 1960 and L. H. Ferrell, Jr., et al. in U.S. Pat. No. 3,090,066, issued May 21, 1963, disclose cement slab finishing trowels in which the worker rotates the pole for adjusting the angle of the float. Other patents showing other means for tilting the float relative to the handle, include U.S. Pat. No. 3,146,481 issued to E. Chiuchiarelli on Sept. 1, 1964 and U.S. Pat. No. 3,798,701 issued to W. Irwin et al. on Mar. 26, 1974. Such devices utilize complicated connection structure for performing the tilting of the float as the operator rotates the elongated pole. Further, with such devices, the operator must remember which way to rotate the pole depending on whether he is performing a pushing stroke or a pulling stroke. Also, the worker must remember to rotate the pole so that the float lies flat at the completion of each stroke to avoid marking the surface. Because such devices utilize a rotational movement of the pole, the sections of the elongated handle must be secured together by means other than non-locking screw connections to avoid having the handle come apart.

It is one object of the present invention to provide a bull float which is easily manipulated without the need to learn or to become skilled at or to remember additional rotational manipulations of the pole handle.

It is another object of the present invention to provide a bull float which is compatible with existing types of handles and specifically non-locking pole handle sections.

It is a further object of the present invention to provide a bull float in which the handle may be kept at a comfortable work height because the leading edge of the float is automatically raised by the conventional pushing and pulling force exerted on the handle by the worker.

It is yet another object of the present invention to provide a float having automatic tilt adjustment in which the worker may selectively stop the automatic tilt adjustment to permit shearing of high spots in the concrete surface.

It is also an object of the present invention to provide a float bracket which automatically adjusts the tilt of the float in accordance with the wetness of the concrete being smoothed by the float.

SUMMARY OF THE INVENTION

These and other objects of the invention are achieved in a tilting mechanism for a concrete bull float which automatically tilts the float blade in response to the force on and the direction of movement of the handle of the float. In the preferred embodiment, the tilting mechanism includes a base member and cover member which are interconnected by a mechanical assembly which moves the base member relative to the cover member in accordance with the force and direction of movement of the pole. The base member pivots relative to the cover member as defined by a "pivotal point" lying below the concrete surface being finished.

DETAILED DESCRIPTION OF INVENTION

Figure 1:
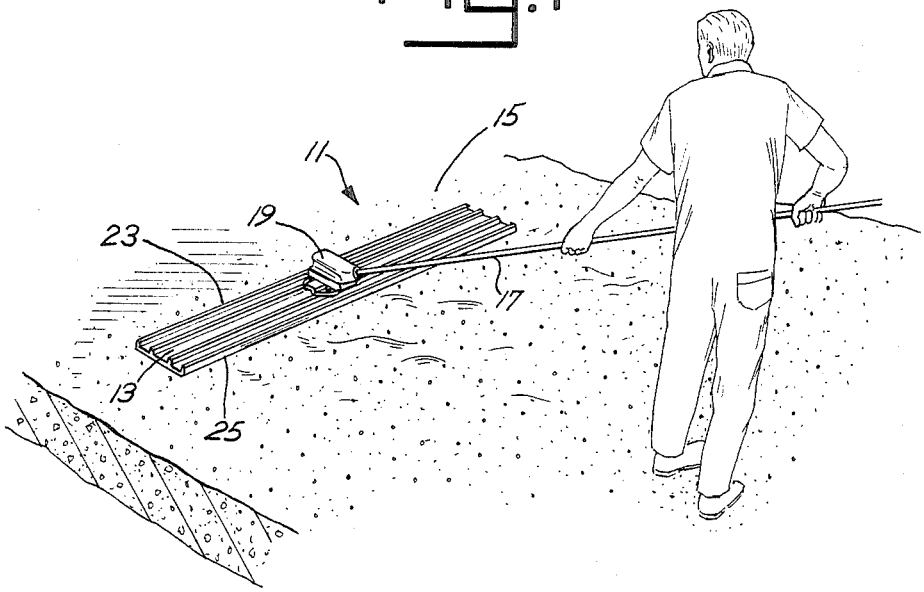
FIG. 1 is a perspective view showing a workman using a bull float having a tilting mechanism of a preferred embodiment of the present invention.

Referring to FIG. 1, a concrete float 11 includes a finishing float or blade 13 for movement across concrete 15 to spread and smooth the concrete prior to hardening. Blade 13 is generally rectangular in shape and usually formed of wood, magnesium, aluminum or other light material, and preferably has a length of 40–54 inches and a width of approximately eight inches. A pole handle 17 is used by a worker from a remote position to reciprocally push and pull the blade across the concrete. Pole 17 is connected to blade 13 by a tilting bracket or mechanism 19.

As the worker pushes pole 17 forward to move blade 13 across the concrete, tilting mechanism 19 causes the forward edge 23 of the float to be lifted upwardly away from the concrete. This prevents the leading edge (forward edge 23) from digging into the concrete. Then as the worker pulls pole 17 toward him, tilting mechanism 19 causes the now leading edge, rear edge 25, of the float to be lifted upwardly away from the concrete. When the worker neither pushes nor pulls the pole handle 17, the float blade lies flat.

The extent of the angle of inclination of the blade 13 is automatically adjusted in accordance with the degree of wetness of the concrete. With dry concrete, the angle of tilt increases, pitching the leading edge higher than with wet concrete.

As shown in FIGS. 2–8, tilting mechanism 19 is formed of a base member 27, a pivotal or cover member 29 and a pair of pivotal links 31, 33. Base member 27 is secured to one or more longitudinal ribs 35 formed integral to the topside of blade 13 and extending upwardly therefrom, as shown, for supporting base member 27. Four screws 37 pass through washers 39, through holes (not shown) drilled in base member 27 and into ribs 35, to hold the base member fixed relative to blade 13. Alternatively, where blade 13 is formed with a single longitudinal rib, a channel 36 formed in the base member receives the top of the rib and holes 38 permit screw securement of the base member to the single rib. In the event that the float blade is of solid, unribbed construction (i.e., a plain wooden panel), suitable fasteners through holes 38 and/or 39 may be used to secure bracket 19 to the blade 13.

Figure 2:
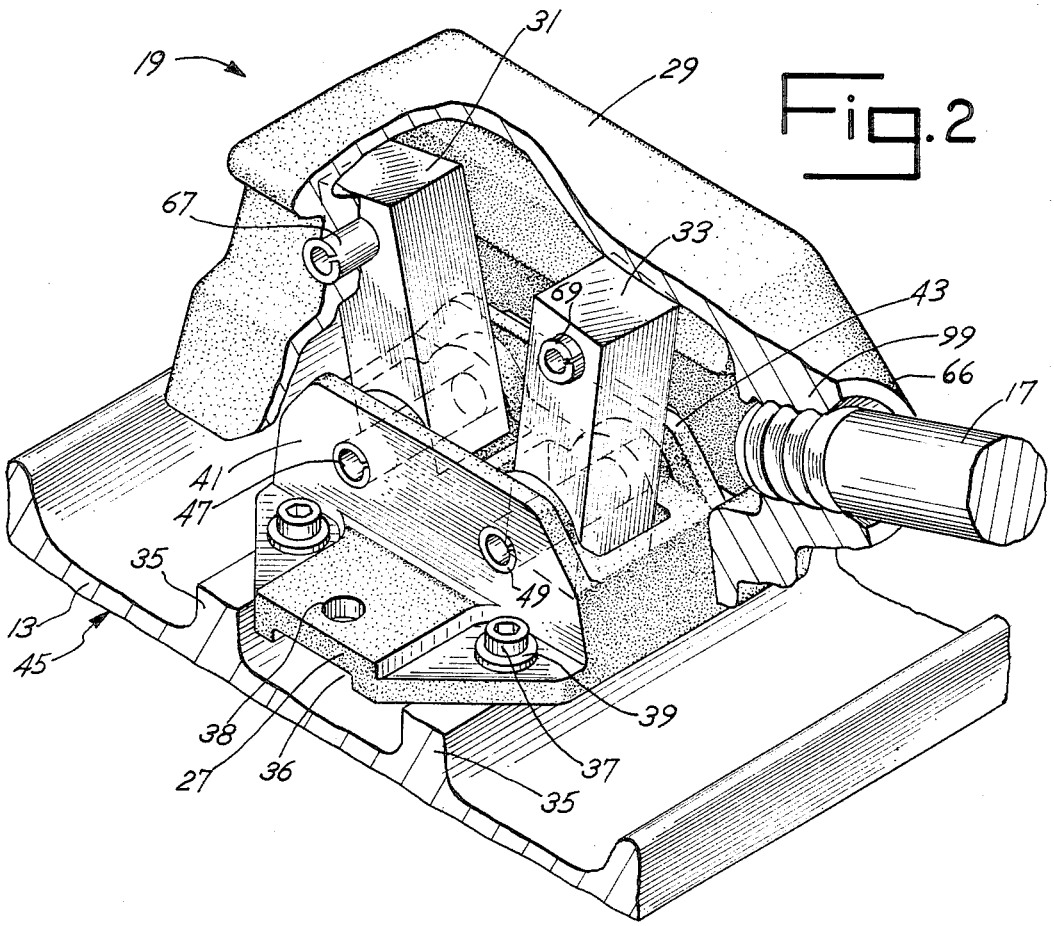
FIG. 2 shows a cut-away perspective view of the tilting mechanism of the bull float of FIG. 1.
Figure 3:
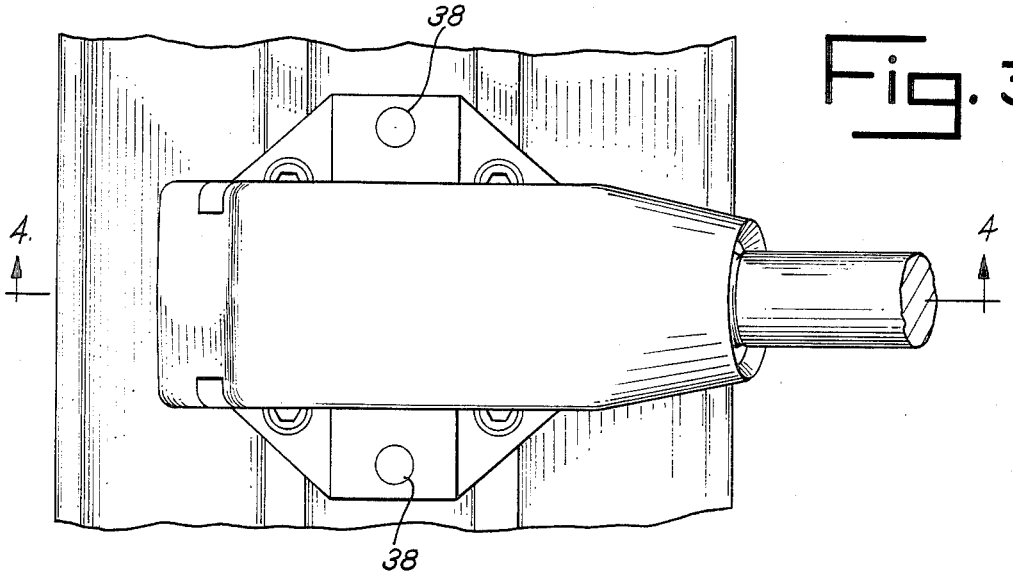
FIG. 3 shows a top view of the tilting mechanism of FIG. 2.

Base member 27 includes a pair of upstanding parallel walls 41, 43 (FIG. 5) disposed substantially orthogonal to the underside finishing face 45 of the blade. The lower ends of links 31, 33 are pivotally secured between walls 41, 43 by a pair of cylindrical bearing surfaces 47, 49 (FIG. 2). Bearing surfaces 47, 49 are supported by walls 41, 43 and are secured in a fixed relationship to base member 27. Links 31, 33 include respective cylindrical openings 51, 53 (FIG. 4) through which pass cylindrical bearing surfaces 47, 49 for permitting the links to pivot about the respective axes 55, 57 (FIG. 4) of the cylindrical bearing surfaces 47, 49. The two axes 55, 57 are disposed parallel to one another lying in a plane generally parallel to finishing surface 45.

Cover member 29 is a generally hollowed, cup-shaped member for covering links 31, 33 and a portion of base member 27 for protecting the area generally indicated at 59, 61 (FIG. 5) where the links pivot on bearing surfaces 47, 49. Concrete, dirt, or other debris is thus prevented from lodging in the pivotal area which might hamper pivoting.

As will suggest itself, cover member 29 need not perform the function of a cover but need only perform the function of providing a structure which is securable to the pole for receiving the pulling and pushing force applied to the pole handle by the worker, and providing a structure to be coupled to the base member for controlling the "pivotal" movement of the blade. Such a structure may be a pair of side walls 70, 72 (FIG. 5) of sufficient height to provide an area for bearing surfaces 67, 69 wherein the side walls are formed integral to a tail member 66, (FIG. 2) having a threaded sleeve 99 for receiving a threaded end of pole 17.

Cover member 29 establishes two pivotal axes 63, 65 (FIG. 4) about which pivot the upper ends of links 31, 33. A pair of cylindrical bearing surfaces 67, 69 (FIG. 4) are secured between the side walls 70, 72 (FIG. 5) of the cover member and have axes 63, 65 (FIG. 4) as their center axes. The bearing surfaces 67, 69 are held fixed relative to cover member 29. Links 31, 33 include respective cylindrical openings 71, 73 (FIG. 4) through which pass cylindrical bearing surfaces 67, 69 (FIG. 2) for permitting the links to pivot about respective axes 63, 65 (FIG. 4).

The two upper axes 63, 65 are disposed parallel to one another and parallel to lower axes 55, 57. As seen from FIG. 4, the plane formed from axes 63, 55 and the plane formed from axes 65, 57 intersect at a pivotal line 75 disposed below the finishing surface 45. Reference numeral 75 may also be referred to as the "pivotal point" in reference to the cross-sectional plane shown in FIG. 4.

The line or "point" of intersection of the two planes (defined by axes 63, 55 and 65, 57) takes on positions different than point 75 (as indicated, for example, by points 77, 79, 81, 83) as base member 27 is pivoted relative to cover member 29. A dotted line 78 represents the locus of points resulting from the intersection of the two planes during the pivotal movement of base member 27 relative to cover member 29. Thus, the "pivot point" of the base member relative to the cover member is a dynamic point, tracing out a curve 78. The pivot point must at all times lie below the finishing face 45 of the blade.

Figure 4:
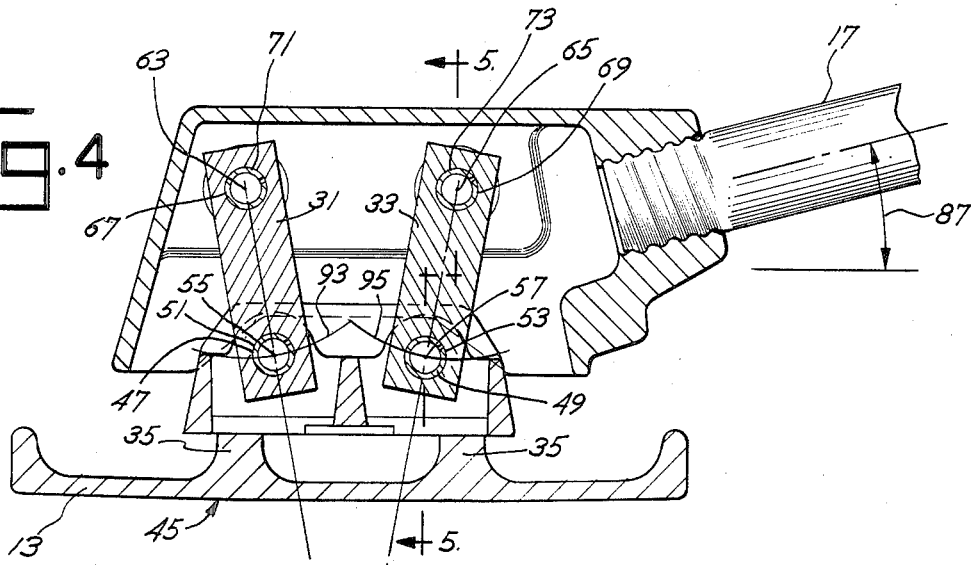
FIG. 4 shows a sectional side view of the tilting mechanism of FIG. 2 taken through line 4—4 of FIG. 3.

When the plane defined by axes 63, 65 is parallel to the plane defined by axes 55, 57 (as shown in FIG. 4) the pivot point takes the position identified by numeral 75. In this position, the pivot point 75 is about 4 inches beneath finishing surface 45. The coefficient of friction provided by the concrete affects the pivoting of the base member relative to the cover member, and therefore the distance of pivot point 75 below the finishing surface 45 is selected for compatibility with the frictional coefficient of the concrete.

Assume, for explanation purposes, that there is no frictional drag on blade 13 as the blade is pulled across the concrete, as though the blade was pulled along in mid air. The blade would not be tilted relative to the cover member but would occupy the relative position shown in FIG. 4 with the pivot point located at point 75. However, in reality, as the blade is moved across the concrete, a frictional force occurs which tilts the blade.

Figure 6:
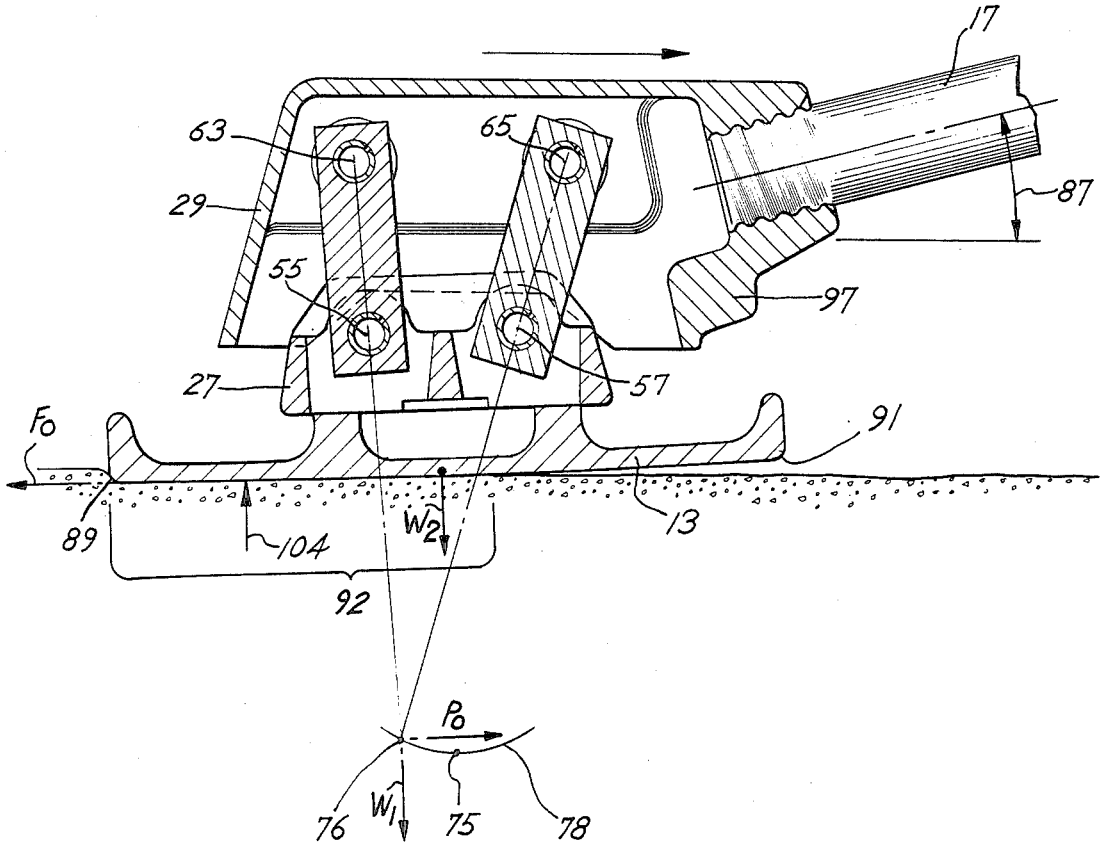
FIG. 6 shows a cross-sectional view of a coupling mechanism of FIG. 4 during a pulling stroke on the float.

FIG. 4, pivot point 75 is below the finish surface 45. Pole handle 17 is pulled by the worker, the frictional drag on the surface 45 of the blade causes relative movement of the blade 13 with respect to base member 27. The friction force of the concrete serves to drag or pull the blade rearwardly relative to the cover member. The pivotal links 31, 33 define the path of the movement of the blade, referred to herein as a pivotal or rotational movement, as the blade is dragged rearwardly. This rotational movement of the blade raises its leading edge 91 (FIG. 6) and shifts the pivot point to location 76 on curve 78. This rotational movement becomes opposed by the gravitational weight of the concrete float 11 bearing upon the surface of the concrete. As the blade 13 and base member 27 rotate, the leading edge 91 is raised so that the float surface 45 is only in partial contact with the concrete surface (FIG. 6). The area 92 of the float surface 45, which is in contact with the concrete surface, supports the weight of the concrete float 11. The support area 92 has moved rearward (as compared to the float in its rest position, FIG. 4) and the distributed force on the support area is the equal of a force centered at the reaction force 104. The force 104 is rearward of the pivot point 76 which is the support center for the weight W1 of the cover 29, and portion of the pole handle 17. The force 104 is also rearward of the center of the weight W2 of the blade 13 and base member 27. The weights of the cover 29, pole handle 17, blade 13 and base 27 are reacting downward and the locations of their weights are laterally disposed forward from the upward force 104 to cause a rotational moment. This rotational moment balances a second rotational moment created by the frictional drag force $F_o$ and the pulling force $P_o$ on the handle.

The wetness of the concrete determines the frictional force $F_o$ and the area 92 which is in contact with the concrete surface. As area 92 moves rearward, so does force 104. As the concrete gets drier, the frictional force gets larger and the angle of tilt increases, pitching the leading edge higher. With wet concrete, the frictional force is lower and the angle of tilt decreases.

For example, with concrete at a wetness $A_1$, the pivot point will occupy position 76 on curve 78 (see FIG. 4). With this wetness $A_1$, the blade is at a small angle of tilt. With concrete at a wetness $A_2$ (drier than $A_1$), the pivot point will occupy position 79 of FIG. 4. With this wetness $A_2$, the blade is at a greater angle of tilt than with concrete at wetness $A_1$. With concrete at a wetness $A_3$ (drier than $A_2$), the pivot point will occupy position 82 of FIG. 4. With this wetness $A_3$, the blade is at a greater angle of tilt than with concrete at wetness $A_2$.

The change in the tilt of the blade is automatically adjusted by the wetness of the concrete itself. This discussion with respect to the frictional effect of the concrete on the extent of the tilt of the blade relative to the horizontal surface of the concrete assumes that the cover member 29 has a constant angular orientation with respect to the horizontal surface of the concrete. The angular orientation of the cover member with respect to the horizontal surface of the concrete may be defined by angle 87.

When the float is in a stationary rest position shown in FIG. 4, the angle between the axis of pole 17 and the finishing surface 45 is approximately 14 degrees. The angle 87 is the angle between the axis of the pole 17 and the horizontal, i.e., the concrete surface. During float operations, angle 87 may take on a value within a range of angles from 4 to 24 degrees.

Using the structure of the preferred embodiment, the angle 87 continuously changes as the blade moves closer and then farther from the worker. Assuming the worker holds the pole handle at waist height, a comfortable position, then when the blade is close to the worker, angle 87 will be greater than when the blade is far from the worker. The blade will pivot relative to the cover member depending on both handle angle and blade friction with the concrete.

Referring again to FIG. 6, the angular orientation of the cover member relative to the concrete (angle 87) varies the location of the pivot point along curve 78. Thus, both the frictional effect of the concrete and the angular orientation of cover member 29 determines the tilt position of the blade relative to the concrete.

Figure 7:
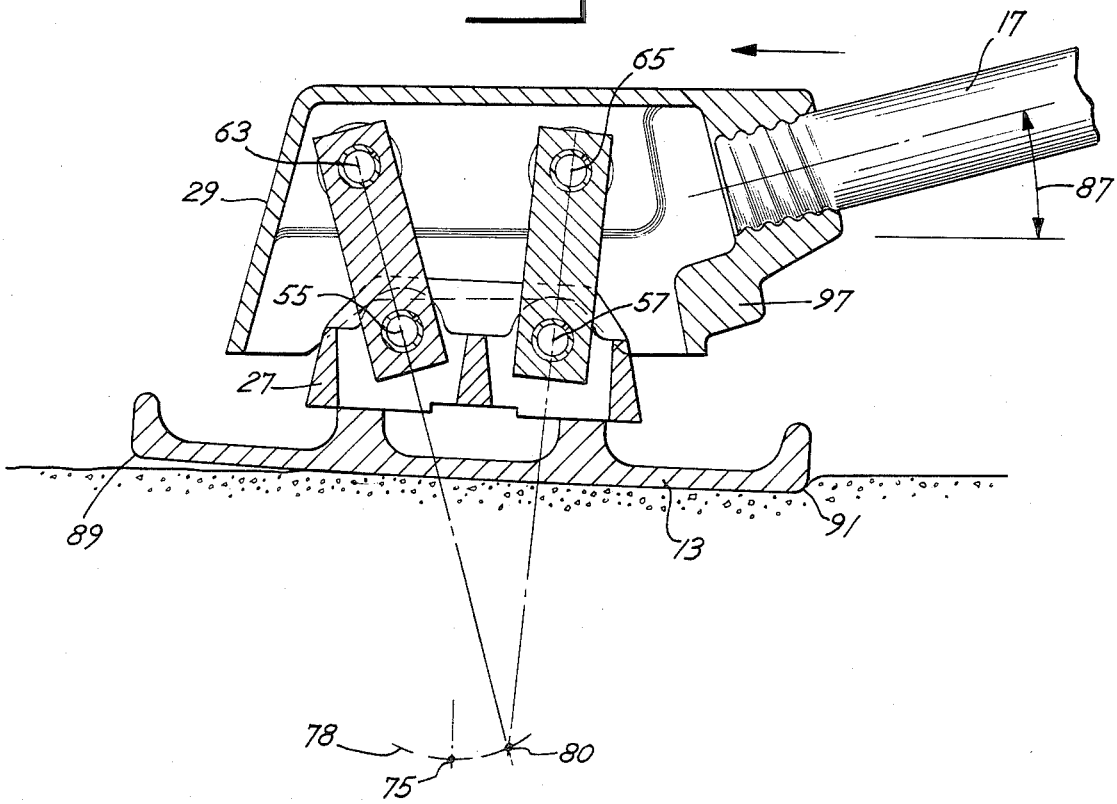
FIG. 7 shows a cross-sectional side view of the coupling mechanism of FIG. 4 during a pushing stroke on the float.

As shown in FIG. 7, during a pushing stroke on pole 17, base member 27 pivots relative to cover member 29. The line of intersection between the plane formed by axes 63, 55 and the plane formed by axes 65, 57 is line or pivot point 80. The angle 87 between the axis of pole 17 and the horizontal is shown at approximately 14 degrees. As the blade is pushed away from the worker, angle 87 will decrease and the blade will automatically pivot relative to the cover member in accordance with the wetness of the concrete.

As pole 17 is pushed (FIG. 7), concrete drag on the face 45 of the float causes the leading edge 89 of the float to be pivoted upwardly away from the concrete. The amount of force which must be supplied to the pole is determined by the amount of frictional drag. The force applied to the pole automatically causes relative pivoting between the base member and the cover member. The same force and moment analysis can be applied to the pushing stroke as was made above with respect to the pulling stroke of FIG. 6.

Figure 8:
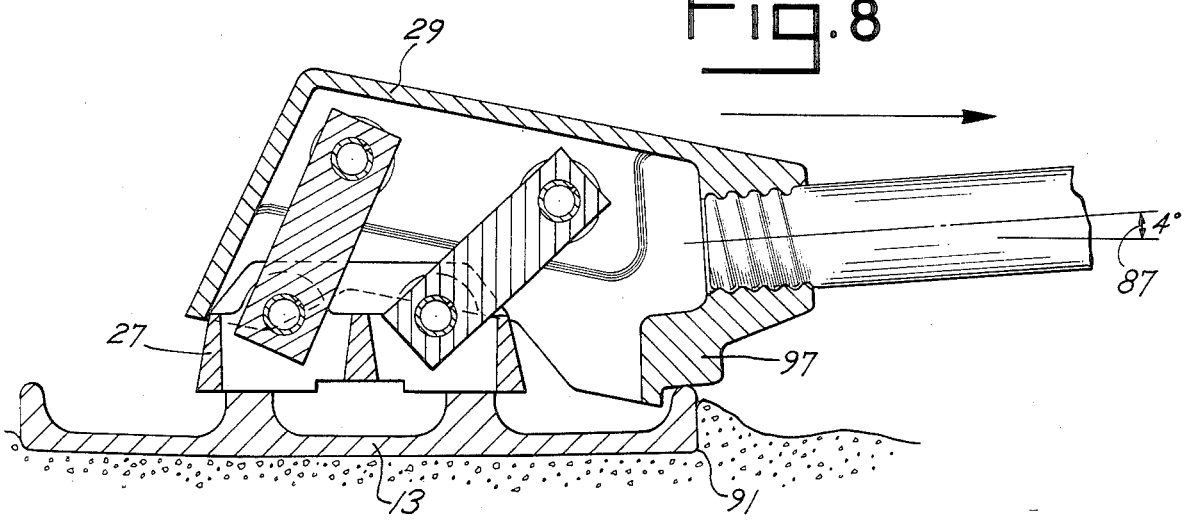
FIG. 8 shows a cross-section view of a coupling mechanism of FIG. 4 during stop-engagement of the blade for shearing high spots in the concrete surface.

Referring again to FIG. 4, axes 55, 57 of the lower ends of respective links 31, 33 follow respective arcuate paths 93, 95 during pivoting of the base member relative to the cover member. When links 31, 33 are pivoted to their forwardmost position on arcuate paths 93, 95, the relative position of cover member 29 and base member 27 is as shown in FIG. 8.

A stop member 97 (FIG. 8) is formed integral to cover member 29 for contacting float blade 13 at this forwardmost pivotal position. At this point, the blade no longer automatically adjusts its tilt. The worker may select this position of the float by lowering the handle until the blade contacts stop 97 (FIG. 6), when angle 87 becomes approximately 4 degrees. The worker may then use the float in this position for shearing off high spots on the concrete surface using leading edge 91 as the worker pulls the float toward him.

Figure 5:
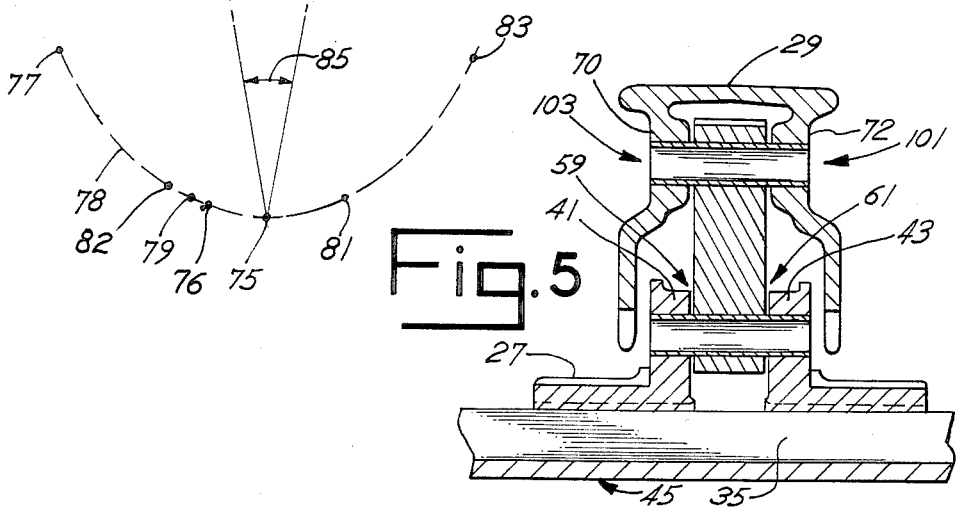
FIG. 5 shows a cross-sectional end view of the tilting mechanism of FIG. 2 taken through line 5—5 of FIG. 4.

Referring again to FIG. 2, cover member 29 is formed with a threaded sleeve 99 at its rearward end for receiving the threaded end of pole handle 17. Sleeve 99 may be secured to the cover member by forming the sleeve integral with the cover member or may be secured to the cover member by other means. The side walls of cover member 29 depend downwardly about links 31, 33 to prevent dirt from entering the pivotal area, as best seen in FIG. 5. As shown in FIG. 5, the cover member may be formed to include depressions 101, 103 to provide a handle for carrying of the float separate from the pole by the workman. As will suggest itself, cover member 29 need not be configured to "cover" the pivotal links but may take on other shapes for establishing the upper pivoting axes 63, 65 of links 31, 33 and carrying the force applied through pole handle 17.

Also, one or more of links 31, 33 may be replaced by cam rollers and a cam track for pivoting the base member relative to the float blade. For example, the base member may carry a cam track and the cover member may carry rollers which follow the cam track.

It is to be understood, of course, that the foregoing describes different embodiments of the present invention and that modifications may be made therein without departing from the spirit or scope of the present invention as set forth in the appended claims.

What is claimed is:

1. A concrete float for use by a concrete worker, comprising:

a float blade, said float blade including a finishing face of uniform width for movement across the top surface of the concrete, said float blade having a pair of edges providing a trailing edge and leading edge during movement of the blade;

a pole handle; and an automatic tilt adjusting bracket for securement to the top side of said float blade and to one end of said pole handle, said tilt adjusting bracket automatically adjusting the position of tilt of said float blade with respect to the top surface of the concrete in accordance with the wetness of the concrete during the movement of the finishing face across the top surface of the concrete, said automatic tilt adjusting bracket comprising:

base member means for securement to the top side of said float blade, said base member means including first and second axes disposed parallel to one another and spaced apart by a prefixed distance;

cover member means mechanically linked to said base member for moving in a defined path relative thereto, said cover member means including third and fourth axes disposed parallel to one another and parallel to said first and second axes, said third and fourth axes being spaced apart a distance greater than said prefixed distance between said first and second axes, said first and third axes forming a first plane and said second and fourth axes forming a second plane, said first and second planes intersecting at a line disposed below said float blade, said line being spaced below said float blade at a distance to provide a force moment for causing an automatic adjustment of the position of tilt of said float blade during movement thereof across the concrete surface in accordance with the wetness of the concrete, said base member means moveable to a plurality of positions of tilt with respect to said cover member means;

mechanical linkage means interconnecting said cover member means to said base member means for controlling the path of movement and the position of tilt of said base member means relative to said cover member means, said mechanical linkage means including two elongated bar links, one end of said first bar link being pivotally connected to said base member means for pivotal movement about said first axis and the other end of said first bar link being pivotally connected to said cover member means for pivotal movement about said third axis, one end of said second bar link being pivotally connected to said base member means for pivotal movement about said second axis and the other end of said second bar link being pivotally connected to said cover member means for pivotal movement about said fourth axis, said mechanical linkage means tilting said base member means relative to said cover member means to a first position of tilt when the wetness of the concrete against said float blade is at a first frictional level during movement of the finishing face across the top surface of the concrete and tilting said base member means to a second position of tilt different from said first position of tilt when the wetness of concrete is at a second frictional level different than said first frictional level during movement of the finishing face across the top surface of the concrete and tilting said base member means to a third position of tilt different than said first and second positions of tilt when the wetness of concrete is at a third frictional level different than said first and second frictional levels during movement of the finishing face across the top surface of the concrete; and pole securement means for connecting said pole handle to said cover member means for providing the pushing and pulling force supplied through said pole handle to said cover member means to mvoe said float blade across the concrete, the pushing of said pole handle applying a force to said cover member means tilting said base member means relative to said cover member means to at least one of a plurality of tilt positions for lifting the leading edge of said float blade upward due to the frictional drag of concrete on the float blade and the pulling of said pole handle applying a force to said cover member means tilting said base member means relative to said cover member to at least one of a plurality of tilt positions for lifting the leading edge of said float blade upward due to the frictional drag of concrete on said float blade.

2. An automatic tilt adjusting bracket for connecting a pole handle and a concrete float blade for finishing concrete, in which the float blade includes a finishing face for movement across the top surface of the concrete as a worker pushes and pulls the pole handle, and wherein the float blade has a pair of edges providing a trailing edge and leading edge during movement of the blade, the tilt adjusting bracket being adapted for securement to the top side of the float blade and to one end of the pole handle, said tilt adjusting bracket automatically adjusting the position of tilt of said float blade with respect to the top surface of the concrete in accordance with the wetness of the concrete during the movement of the finishing face across the top surface of the concrete, said tilt adjusting bracket comprising:

first member means defining a base for securement to the top side of the float blade, said first member means including first and second axes disposed parallel to one another and spaced apart by a prefixed distance;

second member means mechanically linked to said first member means for moving relative thereto, said second member means including third and fourth axes disposed parallel to one another and parallel to said first and second axes, said third and fourth axes being spaced apart by a distance greater than said prefixed distance between said first and second axes, said first and third axes forming a first plane and said second and fourth axes forming a second plane, said first and second planes intersecting at a line disposed below the float blade, said line being spaced below the float blade at a distance to provide a force moment for causing an automatic adjustment of the position of tilt of the float blade during movement thereof across the concrete surface in accordance with the wetness of the concrete, said first member means moveable to a plurality of positions of tilt with respect to said second member means;

mechanical linkage means interconnecting said second member means to said first member means for controlling movement of said first member means relative to said second member means, said mechanical linkage means conjointly pivoting said first axis relative to said third axis along a first arcuate path and pivoting said second axis relative to said fourth axis along a second arcuate path, said mechanical linkage means tilting said first member means relative to said second member means to a first position of tilt when the wetness of the concrete against the float blade is at a first frictional level during movement of the finishing face across the top surface of the concrete and tilting said first member means to a second position of tilt different from said first position of tilt when the wetness of concrete is at a second frictional level different than said first frictional level during movement of the finishing face across the top surface of the concrete and tilting said first member means to a third position of tilt different than said first and second positions of tilt when the wetness of concrete is at a third frictional level different than said first and second frictional levels during movement of the finishing face across the top surface of the concrete; and pole securement means for connecting the pole handle to said second member means for providing the pushing and pulling force supplied through the pole handle to said second member means to move the float blade across the concrete, the pushing of the pole handle applying a force to said second member means tilting said first member means relative to said second member means to at least one of a plurality of tilt positions for lifting the leading edge of the float blade upward due to the frictional drag of concrete on the float blade and the pulling of the pole handle applying a force to said second member means tilting said first member means relative to said second member to at least one of a plurality of tilt positions for lifting the leading edge of the float blade upward due to drag of concrete on the float blade.

3. An automatic tilt adjusting bracket according to claim 2 and further including stop means selectably actuated by the worker for stopping tilting of said first member means relative to said second member means.

4. An automatic tilt adjusting bracket according to claim 3 wherein said stop means is selectably actuated by the worker's movement of the pole handle to a position relative to the concrete surface.

5. An automatic tilt adjusting bracket according to claim 2 wherein said second member means covers at least a portion of said mechanical linkage means.

6. An automatic tilt adjusting bracket according to claim 2 wherein said pole securement means includes a screw threaded wall member for connecting the pole handle to said second member means.

7. An automatic tilt adjusting bracket according to claim 2 wherein said pole securement means is formed integral to said second member means.

8. An automatic tilt adjusting bracket according to claim 2 wherein said first and second axes lie in a plane substantially parallel to the plane of the float blade when said base member means is secured to the top side of the float blade.

9. An automatic tilt adjusting bracket according to claim 2 wherein the said first plane formed by said first and said third axes and said second plane formed by said second and said fourth axes are relatively disposed at approximately twenty degrees.

10. An automatic tilt adjusting bracket according to claim 2 wherein said line is located approximately four inches below said float blade.

11. A concrete float according to claim 1 and wherein said automatic tilt adjusting bracket further includes stop means selectably actuated by the worker for stopping tilting of said base member means relative to said cover means.

12. A concrete float according to claim 11 wherein said stop means is selectably actuated by the worker's movement of said pole handle to a position relative to the concrete surface.

13. A concrete float according to claim 1 wherein said cover member means covers at least a portion of said mechanical linkage means.

14. A concrete float according to claim 1 wherein said pole securement means includes a screw threaded wall member for connecting said pole handle to said cover member means.

15. A concrete float according to claim 14 wherein said pole securement means is formed integral to said cover member means.

* * * * *

UNITED STATES PATENT AND TRADEMARK OFFICE

CERTIFICATE OF CORRECTION

PATENT NO. : 4,722,637

DATED : February 2, 1988

INVENTOR(S) : Herbert C. Glesmann

It is certified that error appears in the above-identified patent and that said Letters Patent is hereby corrected as shown below:

Title page:

Assignee: Marshalltown Trowell Company should be deleted from the patent.

Signed and Sealed this

Twenty-seventh Day of December, 1988

*Attest:*

DONALD J. QUIGG

*Attesting Officer*

*Commissioner of Patents and Trademarks*